United States Patent [19]

Sudduth

[11] Patent Number: 4,573,277

[45] Date of Patent: Mar. 4, 1986

[54] ULTRAVIOLET LIGHT CURING APPARATUS

[76] Inventor: Donald L. Sudduth, 181 N. Harbor Dr., Redondo Beach, Calif. 90277

[21] Appl. No.: 686,441

[22] Filed: Dec. 26, 1984

[51] Int. Cl.[4] ..... F26B 15/04

[52] U.S. Cl. ..... 34/4; 34/39; 34/236; 118/642; 198/416

[58] Field of Search ..... 34/4, 39, 105, 236; 118/641, 642, 643; 198/410, 416, 453, 803

[56] References Cited

U.S. PATENT DOCUMENTS

| | | | |
|---|---|---|---|
| 1,699,976 | 1/1929 | Langsner | 34/105 |
| 2,445,451 | 7/1948 | Padelford | 118/642 |
| 3,045,358 | 7/1962 | Breakell et al. | 34/105 |
| 3,766,851 | 10/1973 | Sirvet | 198/689 |
| 3,840,999 | 10/1974 | Whelan | 34/105 |
| 4,297,583 | 10/1981 | Nerod | 34/4 |
| 4,348,816 | 9/1982 | Arippol | 198/416 |

*Primary Examiner*—Larry I. Schwartz
*Assistant Examiner*—David W. Westphal
*Attorney, Agent, or Firm*—Keith D. Beecher

[57] ABSTRACT

Apparatus for ultraviolet light curing by photopolymerization of ultraviolet curable ink printings on the external surfaces of tubular articles, such as plastic, glass or metal bottles, jars or other containers. The tubular articles are placed in an upright position on a rotating disc in a housing which carries them through an ultraviolet radiation field emitted by an appropriate ultraviolet source, and reflected by specially shaped reflectors to provide intense ultraviolet radiation in the entire housing and thereby eliminating the need to stop and spin the articles in front of the ultraviolet source to achieve complete curing around the entire article. An elongated guide is mounted to extend partially across the upper surface of the table, and as the table rotates it serves to move the articles against the guide which causes them to rotate about their respective vertical axes so that the entire peripheral surface of each tubular article is exposed to the ultraviolet radiation. The table then carries the articles to an appropriate unloading station.

7 Claims, 5 Drawing Figures

ULTRAVIOLET LIGHT CURING APPARATUS

BACKGROUND OF THE INVENTION

Ultraviolet curable inks are presently in widespread industrial use for imprinting identifications, advertising messages, directions, and the like, on tubular articles, such as plastic bottles. One such apparatus for applying such ink to plastic or glass bottles or other articles is described, for example, in U.S. Pat. No. 3,766,851. After the ink has been imprinted on the bottle, the bottle is placed into curing apparatus in accordance with the prior art practice which subjects the ink to ultraviolet radiation. It is necessary for the entire peripheral surface of each bottle to be exposed to the ultraviolet radiation to assure that all the imprinted ink will be cured.

Accordingly, ultraviolet apparatus has been devised in the past to achieve that purpose. U.S. Pat. No. 3,840,999 (Re. 29,590), for example, provides such ultraviolet curing apparatus in which the articles are moved in succession along a pathway through a curing oven. An ultraviolet radiation-emitting lamp is mounted to direct ultraviolet radiation through the oven. The lamp radiates ultraviolet radiation primarily in one direction, and the articles are moved through the oven into and through the radiation field from the lamp. In order that the entire peripheral surface of each article may be exposed to the radiation from the lamp, the articles are rotated around their longitudinal axes as they are moved through the radiation. This is achieved by supporting the articles on mandrels which carry the articles through the oven and across the radiation field. At the same time, the mandrels are rotated so that each article may be turned in order to expose its entire peripheral surface to the ultraviolet radiation. This serves to assure that all the ink printings on the surface of each article may be properly cured.

Apparatus of the type described in U.S. Pat. No. 3,840,999, although well suited for its particular purpose, is relatively complex, and it is not readily adaptable to handle articles of different shapes and sizes. In fact, a complicated adjustment procedure must be followed to enable the apparatus of the patent to process articles of different shapes and sizes.

An object of the present invention is to provide an ultraviolet curing apparatus which is extremely simple and inexpensive in its construction, and which is capable of handling articles of a wide range of shapes and sizes with extremely simple adjustment requirements.

SUMMARY OF THE INVENTION

The apparatus of the invention comprises a horizontal rotating disc driven, for example, by an appropriate electric motor. The disc is rotated about a vertical axis within a housing. An ultraviolet lamp assembly is mounted adjacent to the housing to direct ultraviolet radiation into the housing and into a specially shaped reflector which directs the radiation throughout the interior of the housing. The rotating disc is positioned so that articles placed in their upright position on the disc will be carried through the housing and into the ultraviolet radiations emitted by the ultraviolet lamp and reflected by the reflector.

The housing includes a loading port through which the articles to be processed are manually mounted in upright positions on the rotating disc. The disc then carries the articles through the ultravoilet radiation emitted by the lamp. A first elongated arcuate stationary guide is provided which extends partially across the disc, and the articles are moved by the disc against the guide and are caused individually to rotate about their vertical axes by the guide as they are forced by the guide from the outer edge of the disc towards the center. The articles are then directed from the center of the disc back to its outer edge by a second guide as they rotate in the opposite direction, so that the entire peripheral surface of each article may be exposed to the ultraviolet radiation. An unloading station is provided in the housing through which the processed articles are discharged from the apparatus. The articles are carried to the unloading station by the disc and are directed to the unloading station by a second stationary guide.

DETAILED DESCRIPTION OF THE ILLUSTRATED EMBODIMENT

Figure 1:
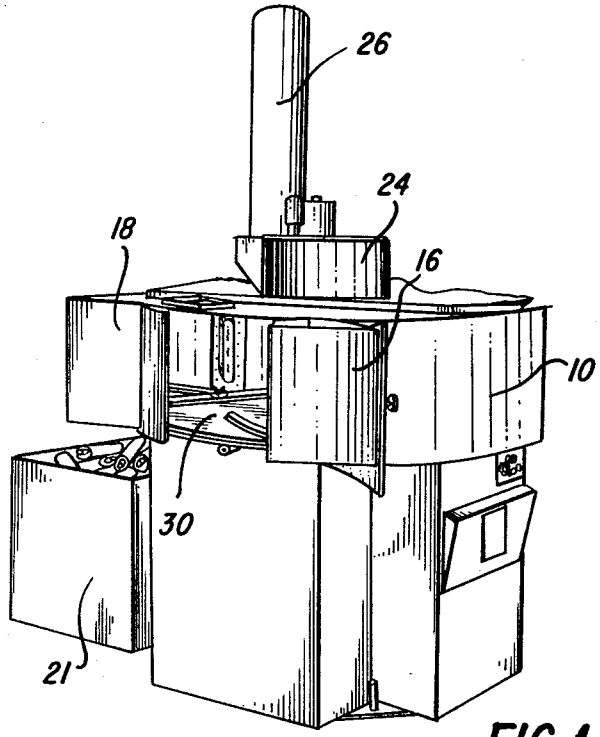
FIG. 1 is a side perspective view of apparatus constructed in accordance with the concepts of the invention.
Figure 2:
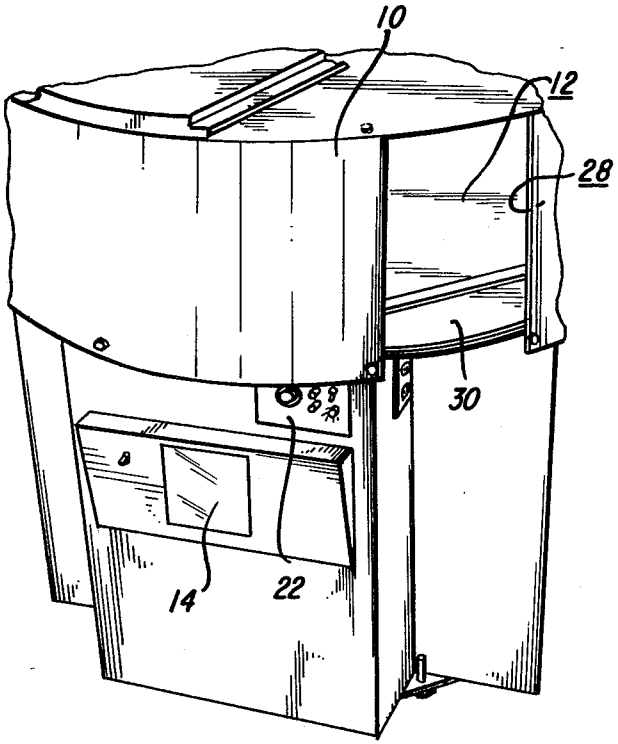
FIG. 2 is a view of the apparatus, like FIG. 1, with the apparatus rotated slightly about its vertical axis.
Figure 5:
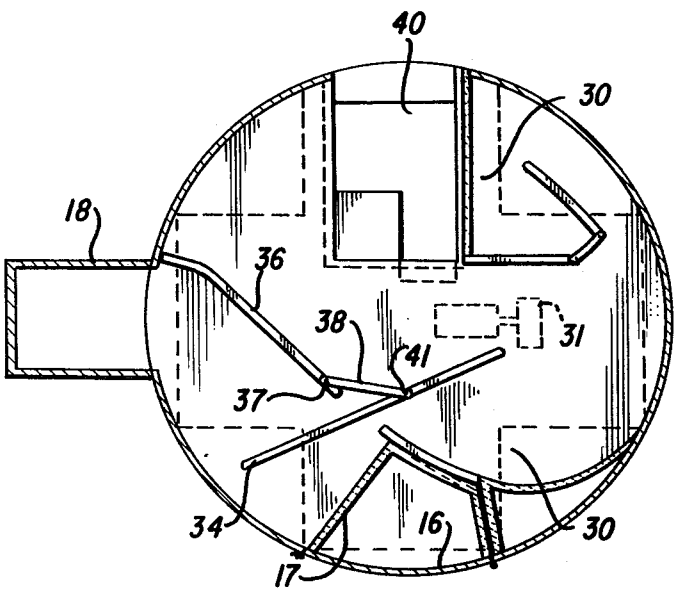
FIG. 5 is a sectional view of the apparatus, taken essentially along the line 5—5 of FIG. 3.
Figure 3:
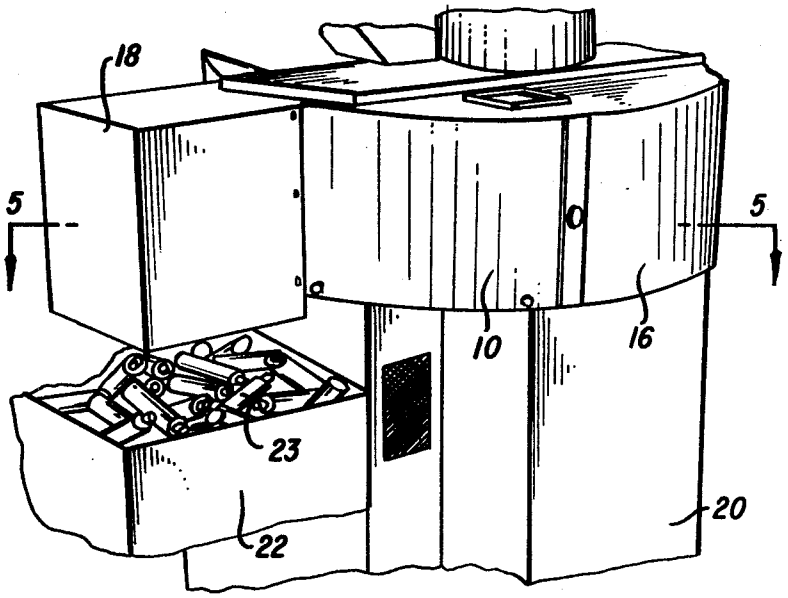
FIG. 3 is another view, like FIG. 2, with the apparatus being rotated still further about its vertical axis.

As shown particularly in FIGS. 1—3, the apparatus of the invention includes a housing having an upper cylindrical-shaped section 10 and a lower section 20, with the upper section being supported on the lower section. A disc 30 is contained within the upper section 10. The disc is rotatably driven by a motor 31 (FIG. 5) so that it rotates in a horizontal plane about a vertical axis within the housing. An entrance port 12 is provided in the upper section 10, through which articles, such as bottles 23 are inserted into the apparatus. Each article is placed in an upright position on the rotating disc.

Figure 4:
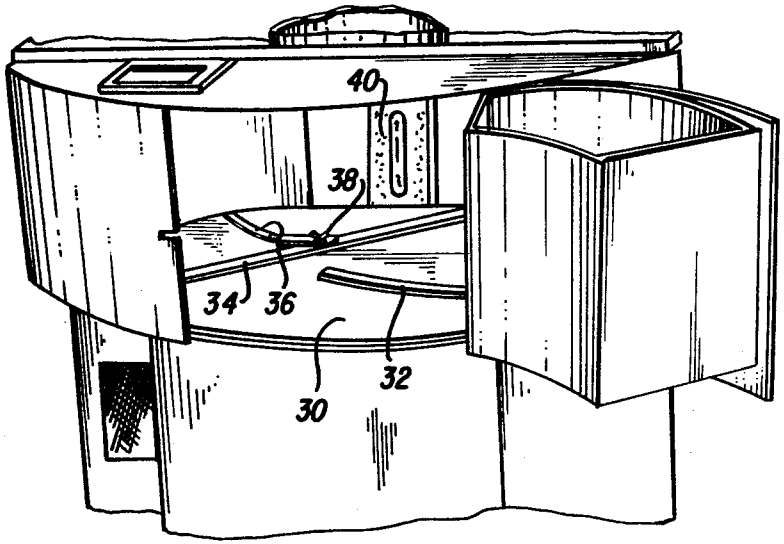
FIG. 4 is a view of the apparatus of FIG. 1, with an access door in an open position, and showing an ultraviolet lamp assembly positioned diametrically opposite the opening normally closed by the access door, and also showing a reflector of a predetermined shape mounted on the internal surface of the access door.

After the articles have been inserted into the apparatus, they are carried by the disc 30 against an arcuate elongated guide 32 (FIG. 4) which causes the articles to rotate in a first direction about their vertical axes and causes the articles to move from the outer edge of the disc 30 to its center. The articles are then directed by a linear guide 34 (FIG. 4) back to the outer edge of the disc and to an unloading station 18 while rotating in the opposite direction. The articles then drop into a container 22 (FIG. 3).

Appropriate controls 14 and 22 are provided, which control an ultraviolet lamp assembly 40, as well as the disc 30. The ultraviolet lamp assembly directs ultraviolet radiation into the interior of the housing. An access door 16 is provided on the housing, and it is equipped with a reflective inner surface. The access door 16 is positioned diametrically opposite to the ultraviolet lamp assembly 40. A reflector 17 of a predetermined shape is mounted on the interior surface of the access door, and radiation from the ultraviolet lamp assembly impinges on the reflector to be reflected thereby throughout the entire interior of the housing. This assures that each article is thoroughly irradiated by the ultraviolet rays from the lamp as the articles are carried by the disc 30 from the entrance port 12 to the unloading station 18, and as the individual articles are rotated by the guides 32 and 36 they are carried through the ultraviolet radiation within the housing.

The guide 34 is mounted on a support bracket 36 by a link 38, which is pivotally coupled to the support bracket and guide by pins 39, 41. Guide 34 may be adjusted in position to accommodate different sizes of articles 23. An exhaust fan 24 is mounted on top of the housing which serves to remove heated air from the interior of section 10 through a chimney 26.

The invention provides, therefore, a simple and improved curing apparatus which readily accommodates different sizes of articles to be cured, and which assures that each article will be thoroughly irradiated by the ultraviolet radiations throughout its entire peripheral surface.

It will be appreciated that while a particular embodiment of the invention has been shown and described, modifications may be made, and the following claims are intended to define all modifications which come within the true spirit and scope of the invention.

I claim:

1. Apparatus for curing ultraviolet curable inks on articles, such as bottles, and the like, comprising: a housing having a loading port and an unloading port; a common rotatable disc mounted in the housing having a horizontal top surface for carrying a plurality of the articles each in an upright position from the loading port to the unloading port; a source of ultraviolet radiation mounted adjacent to the housing for directing ultraviolet radiation into the housing so that each of the articles is carried by the common disc into the radiation; and a guide member mounted in said housing and extending at least partially across the disc in position to engage the articles carried by the disc to cause each of the articles to turn about its vertical axis to expose its entire peripheral surface to the ultraviolet radiation.

2. The apparatus defined in claim 1, in which said guide member is mounted in a stationary position in said housing.

3. The apparatus defined in claim 2, in which said guide member is in the form of an elongated strip.

4. The apparatus defined in claim 3, in which said guide member has a generally arcuate configuration and causes the articles to move from the outer edge of the disc towards the center while turning about their vertical axes in one direction.

5. The apparatus defined in claim 4, and which includes a second elongated guide member mounted in said housing and extending at least partially across the disc to serve to direct the articles in succession from the center of the disc back towards the outer edge thereof while rotating in the opposite direction towards said unloading port.

6. The apparatus defined in claim 5, in which said second elongated guide member is linear in shape, and is angularly adjustable to adapt the apparatus to articles of different sizes.

7. The apparatus defined in claim 1, and which includes a reflector mounted in said housing diametrically opposite to said source and having a particular shape to reflect the ultraviolet radiation from the source throughout the interior of the housing.

* * * * *